US005752704A

United States Patent [19]

Todokoro

[11] Patent Number: 5,752,704

[45] Date of Patent: May 19, 1998

[54] GAME BOARD

[75] Inventor: Masatoshi Todokoro, Matsudo, Japan

[73] Assignee: Agatsuma Co., Ltd., Tokyo, Japan

[21] Appl. No.: 861,067

[22] Filed: May 21, 1997

[30] Foreign Application Priority Data

Aug. 26, 1996 [JP] Japan ..... 8-009874

[51] Int. Cl.[6] ..... A63F 9/00

[52] U.S. Cl. ..... 273/447

[58] Field of Search ..... 273/447, 412, 273/236, 140, 139, 138.2, 440

[56] References Cited

U.S. PATENT DOCUMENTS

| | | | |
|---|---|---|---|
| 1,863,358 | 6/1932 | Terasaka | 273/447 |
| 3,545,750 | 12/1970 | Stachnik | 273/447 |
| 4,118,026 | 10/1978 | Todokoro | 273/447 |
| 4,310,156 | 1/1982 | Kulesza et al. | 273/447 |
| 4,650,192 | 3/1987 | Todokoro | 273/447 |
| 4,790,532 | 12/1988 | Chen | 273/447 |
| 4,936,574 | 6/1990 | Lee | 273/447 |

*Primary Examiner*—William E. Stoll

*Attorney, Agent, or Firm*—Longacre & White

[57] ABSTRACT

A game board can be easily operated by infants and a game can be enjoyably played therewith for a long time, comprising; an arbitrary number of sunk rooms 9 extending downward from arbitrary positions in the disk surface of a rotary disk 4 supported by a table board 1; cutout holes 11 12 bored in the side wall of each of the sunk rooms 9; engagement parts 13 14 formed in lower parts of hole edges each defining the cutout holes 11 12; receptacles 15 for receiving flight bodies 16, each fitted in the sunk rooms 9 with a spring 22 interposed so as to be able to rise/fall freely; interlock projections 19, 20 which each fit in the cutout holes 11, 12 of the sunk rooms 9 and engage with the engagement parts 13, 14; and a group of projections, being equipped on a bottom plate of the table board 1, each releasing the interlock projections 19, 20 from the engagement by each hitting against the interlock projections 19, 20 shifting together with the rotation of the rotary disk 4, caracterized in that a side wall part 7 is formed by bending downward a rim part of the rotary disk 4, a roller 26*a* rotating in contact with the side wall part 7 is equipped, a drive motor 24 for rotating the roller 26*a* is equipped, and a switch 30 for a power supply 29 is attached on the surface of the table board 1.

1 Claim, 5 Drawing Sheets

GAME BOARD

BACKGROUND OF THE INVENTION (1) Field of the Invention

The present invention relates to a game instrument which is made so that game players may scramble to scoop up fish leaping up arbitrarily with a scooping net.

(2) Description of the Prior Art

The applicant of the present invention previously provided a game board (JP. Utility Model Application No.51-178235) in which flight bodies such as dummies of a fish are propped on each of seat plates fitted, so as to be able to rise/fall freely, with a spring interposed, in each of sunk rooms equipped in various parts of a rotary disk, and when rotational power is transmitted to the rotary disk after each of the seat plates is lowered against the spring and put in interlock, each of the seat plates being released from the interlock disorderly at time intervals, each of the seat plates is raised rapidly by a spring pressure, causing each of the flight bodies on each of the seat plate to leap up, and game players scramble to scoop up each of the leaping flight bodies with a scooping net or the like.

In the case of the prior game boards, the rotary disk is rotated or stopped by using a power source comprising a windup spring and a drive gear in combination with a brake mechanism comprising a brake actuating lever for stopping the rotating rotary disk and a group of reduction gears, and therefore a rotational speed of the rotary disk is inconstant and goes down below a predetermined speed when the windup spring becomes loose, there existing a trouble that the spring needs to be rewound at every game or in the course of a game.

In particular, it is a burden for little infants to wind the spring by themselves.

This invention was accomplished in view of the above problems and has an object to provide a game board which can be easily operated by infants and with which a game can be enjoyably played for a long time.

SUMMARY OF THE INVENTION

In order to solve the aforesaid problems, a game board according to the present invention comprises; a rotary disk supported freely-rotatably in the center of a table board; an arbitrary number of sunk rooms extending downward from arbitrary positions in the disk surface of the rotary disk; vertically oblong cutout holes bored in the side wall of each of the sunk rooms; engagement parts formed in lower parts of hole edges each defining the cutout holes; receptacles each fitted, with a spring interposed, in the aforesaid sunk rooms so as to be able to rise/fall freely, each being capable of receiving flight bodies such as dummies of a fish inside thereof; interlock projections which each fit in the cutout holes of the aforesaid sunk rooms and engage with the aforesaid engagement parts when each of the receptacles is lowered against the spring; and a group of projections, being equipped on a bottom plate of the aforesaid table board, which is installed under the aforesaid sunk rooms, each releasing the interlock projections from the engagement by each hitting against the interlock projections, in engagement with each of the aforesaid engagement parts, shifting together with the rotation of the rotary disk; characterized in that a side wall part is formed by bending downward a rim part of the aforesaid rotary disk, a roller rotating in contact with the aforesaid side wall part is equipped, a drive motor for rotating the aforesaid roller via reduction gears is equipped, and a switch for a power supply to the aforesaid motor is attached on the surface of the aforesaid table board.

DETAILED DESCRIPTION OF THE PREFERRED EMBODIMENT

Figure 1:
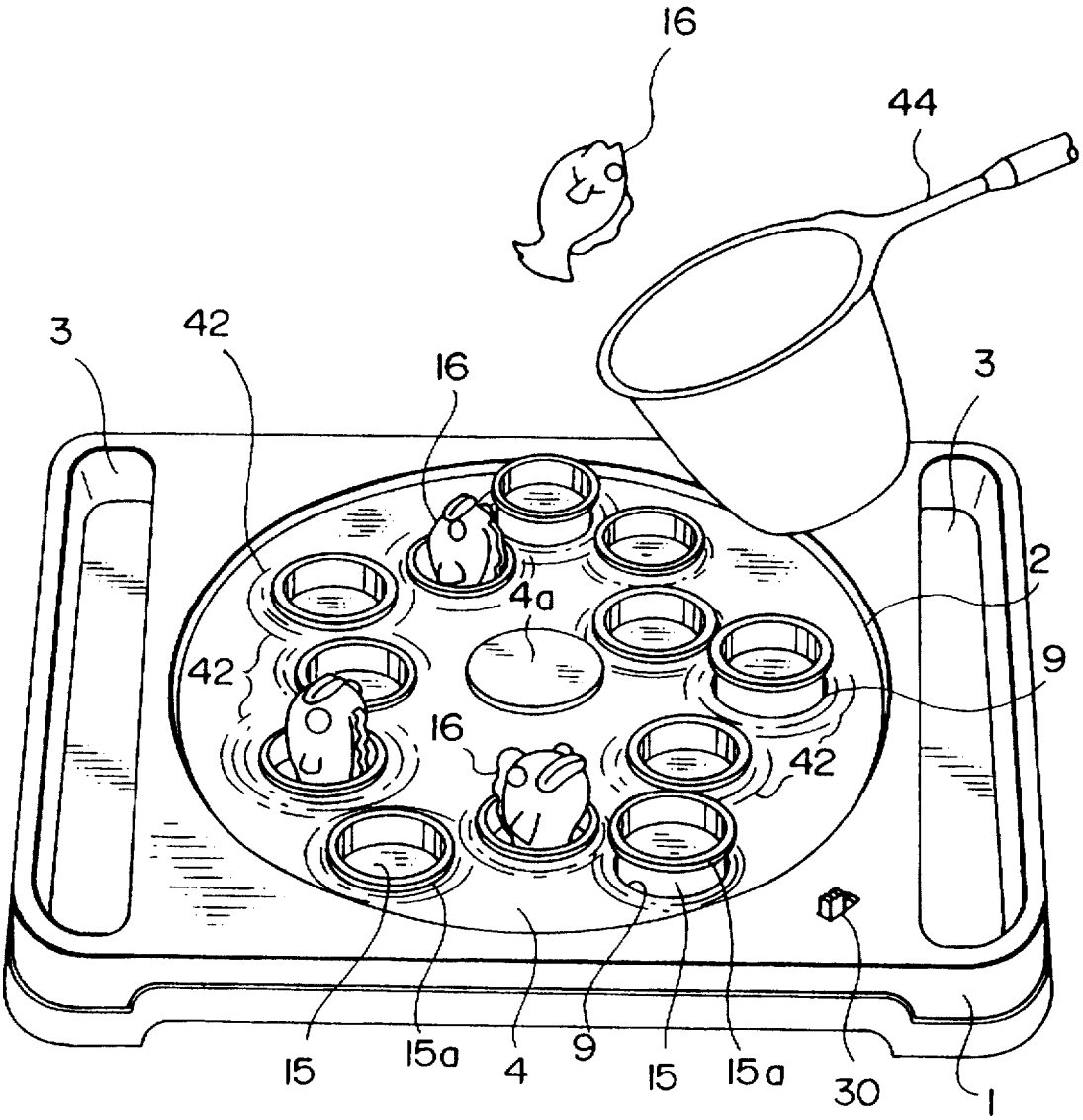
FIG. 1 is a perspective view illustrating a state of use of a game board according to the present invention.
Figure 2:
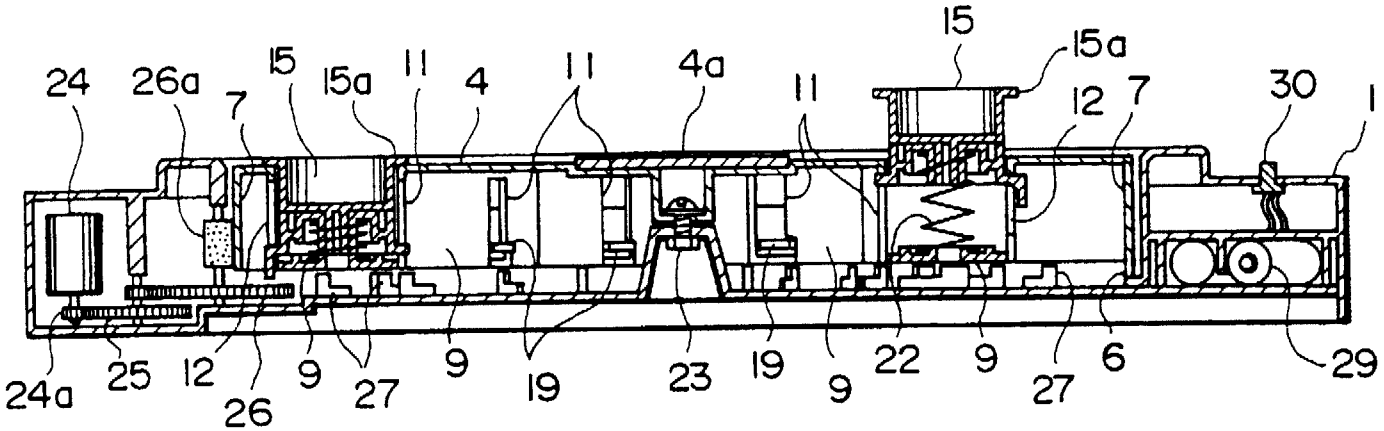
FIG. 2 is a sectional view concerning FIG. 1.
Figure 3:
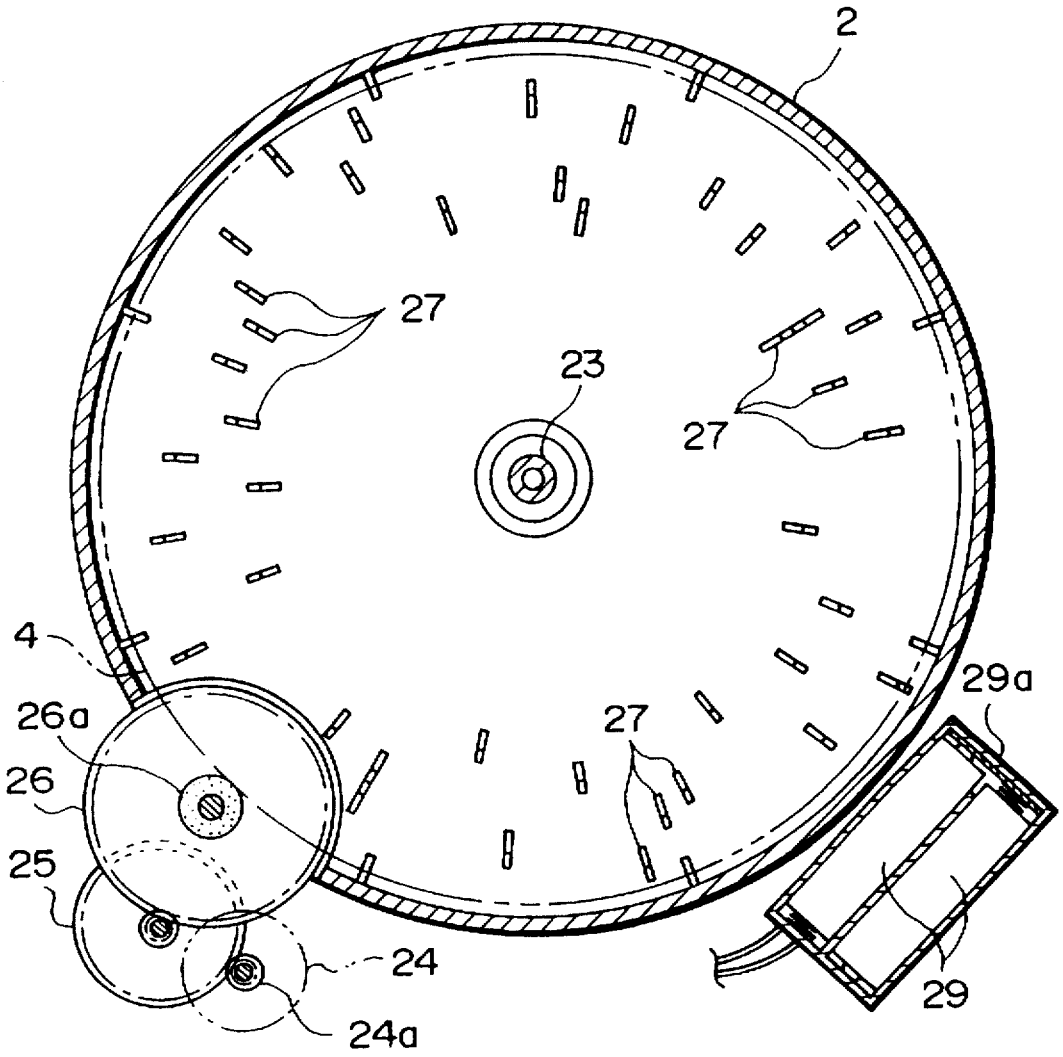
FIG. 3 is a top plan view of a recessed part, in which a rotary disk is fit, of the game board shown in FIG. 1.

A preferred embodiment of the present invention is now described referring to the drawings.

In FIG. 1 showing the embodiment of the present invention, the reference numeral 1 denotes a table board. The table board 1 is equipped with a circular recessed part 2 in the middle thereof and oblong recessed parts 3 respectively in both side parts thereof. The numeral 4 denotes a rotary disk fitted in the recessed part 2, the disk surface of which is colored light blue, and which is equipped with a side wall part 7 extending downward from a rectangularly bent rim part of the rotary disk 4 with its lower end supportrd by a step part 6 projectingly installed on an inside wall of the recessed part 2.

The numeral 9 denotes cylindrical sunk rooms formed in the rotary disk 4 so as to extend downward vertically from twelve positions, in the disk surface thereof, arbitrarily spaced from the center thereof, grooves 42 representing water rings being engraved in the aforesaid disk surface around the opening part of each of the sunk rooms 9, and provided are a pair of vertically oblong cutout holes 11, 12, which are bored respectively at the closest part to the center of the rotary disk 4 and at the opposite part thereto in the side wall of each of the aforesaid sunk rooms 9, and also engagement step parts 13, 14 formed by cutting lower parts of a pair of hole edges located opposite to each other among hole edges defining each pair of the cutout holes 11, 12.

The numeral 15 denotes bottom-having cylindrical receptacles each of which is fitted in each of the sunk rooms 9 so as to be able to rise/fall freely, being capable of receiving a flight body 16 such as a dummy of a fish inside thereof, and is equipped with interlock projections 19, 20 which are projectingly installed in one body with the circumferential part thereof at positions located diametrically opposite to each other, fit in the aforesaid cutout holes 11, 12 respectively, and engage with the aforesaid engagement step parts 13, 14 respectively when each of the receptacle 15 is lowered, and the interlock projection 20 fitted in the cutout hole 12 has an outer end projecting outside of the sunk room 9 and a bent contact piece 21 extending downward from the projecting end.

The numeral 22 denotes coil springs each installed between the bottom surface of each of the receptacles 15 and the inner surface of the bottom of each of the sunk rooms 9, each of which supports each of the receptacles 15 so that only a brim part 15*a* formed on the upper end thereof to have an outer diameter larger than that of the receptacle 15 may project from the top surface of the rotary disk 4 and that the bottom surface of the brim part 15*a* may contact with the top surface of the rotary disk 4, and along with this, when each of the receptacles 15 which has been lowered against the coil spring 22 is going to rise by a spring pressure, the coil spring 22 rotates each of the receptacles 15 in the direction that causes the interlock projections 19, 20 to engage with the engagement step parts 13, 14.

The numeral 23 denotes a spindle for supporting the rotary disk 4 freely-rotatably in the centeral part of the table board 1, and a lid body 4*a* is attached above the spindle 23 for covering the central part of the rotary disk 4.

The numeral 24 denotes a drive motor as a power source for rotating the rotary disk 4, which is installed in a corner within the table board 1. A drive gear 24*a* is fixed to the rotary shaft of the drive motor 24, and the gear 24*a* is in mesh with a driven gear 26 via a group of reduction gears 25. A roller 26*a* which is made of a rubber or a plastics is fixed to the rotary shaft of the driven gear 26, and the roller 26*a* rotates with its circumferential surface contacting with the external circumferential surface of the side wall part 7 of the rotary disk 4. The rotary disk 4 is rotatingly driven according to the rotatation of the roller 26*a*.

The numeral 27 denotes a group of projections projectingly installed on the internal surface of the bottom of the recessed part 2, which are projectingly installed disorderly in a shift area where the contact pieces 21, which are equipped on the interlock projection 20 of each of the receptacles 15 that are lowered against the coil spring 22 and put in interlock in each of the sunk rooms 9, shift together with the rotation of the rotary disk 4, and when each of the contact pieces 21 hits against one of the projections 27, the corresponding interlock projections 19, 20 are released from the corresponding engagement step parts 13, 14.

A battery container 29*a* for housing a battery 20 as a power supply to the drive motor 24 is equipped in a corner opposite to the the drive motor 24 within the table board 1, and a switch 30 for the battery 29 is fixed on the surface of the table board 1 above the battery container 29.

Figure 4:
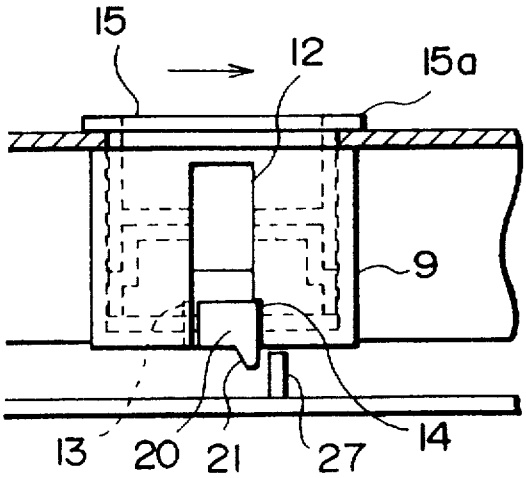
FIG. 4 is a side view of a state of a receptacle which has been lowered against a coil spring and put in interlock in a sunk room of the game board shown in FIG. 1.
Figure 5:
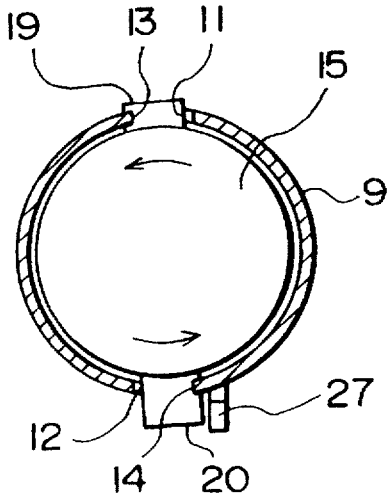
FIG. 5 is a top plan view concerning FIG. 4.

Operation of the game board thus constituted is now described. Flight bodies 16 are received respectively in the receptacles 15, and then, as shown in FIG. 4, each of the flight bodies is pushed down manually until each of the receptacles 15 is lowered to reach the bottom of each of the sunk rooms 9 and thereafter released. Thereupon, each of the receptacles 15 is rotated in the direction shown by the arrow in FIG. 5 by the coil spring 22, and at the same time, the interlock projections 19, 20 are shifted to positions to cause respective engagement with the engagement step parts 13, 14, resulting in that each of the receptacles 15 is interlocked at a lowered position.

In this state, the drive motor 24 gets started by turning on the switch 30, and the driven gear 26 is rotated at a reduced speed by rotational power of the drive motor 24 transmitted from the drive gear 24*a* via the group of reduction gears 25. The roller 26*a* rotates simultaneously with the driven gear 26 rotating, and the rotary disk 4 is rotated continuously at a constant rotational speed by the roller 26*a*.

Figure 6:
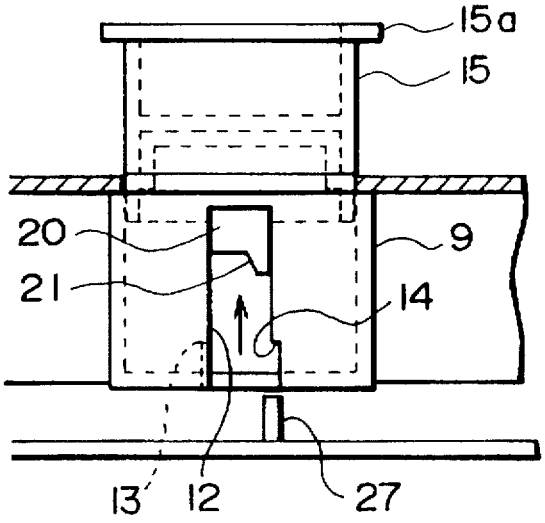
FIG. 6 is a side view of the receptacle of the game board shown in FIG. 1 which has been raised rapidly by a spring pressure of the coil spring after the receptacle is released from the interlock.
Figure 7:
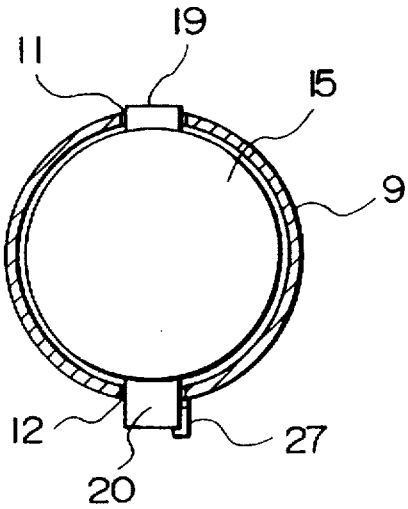
FIG. 7 is a top plan view concerning FIG. 6.

While the rotary disk 4 rotates, each of the contact pieces 21 hits against one of the projections 27, and thereby each of the interlock projections 19, 20 is shifted, as shown in FIG. 7, to a position to cause disengagement from each of the engagement step parts 13, 14, and therefore, as shown in FIG. 6, each of the receptacles 15 rises rapidly and disorderly at time intervals, causing each of the flight bodies 16 to leap up above the rotary disk 4.

When each of the flight bodies 16 leaps up, as shown in FIG. 1, scooping nets 44 are stretched out, aiming at the leaping flight body 16, for scrambling to scoop up the flight body 16, and the scooped flight body 16 is put in the recessed part 3 of the table board 1.

After all the flight bodies 16 have leaped up, the switch 30 is turned off and one game ends.

In addition, the shape, number, location, and the like of the sunk rooms 9 equipped in the rotary disk 4 may be changed suitably, and all kinds of dummies can be adopted as the flight bodies 16 without limiting to dummies of a fish.

The present invention constituted as described above provides the game board with which great amusingness is given to emulation in timing of scooping up each of flight bodies because the flight bodies leap up disorderly at time intervals from various parts of a rotary disk while the rotary disk rotates, and along with this, which can be operated easily even by infants because the rotary disk is rotationally driven by a drive motor via a group of reduction gears, and therefore a game can be enjoyably played for a long time.

What is claimed is:

1. A game board comprising:

a rotary disk supported freely-rotatably in the center of a table board;

an arbitrary number of sunk rooms extending downward from arbitrary positions in the disk surface of said rotary disk;

vertically oblong cutout holes bored in the side wall of each of said sunk rooms;

engagement parts formed in lower parts of hole edges each defining said cutout holes;

receptacles each fitted, with a spring interposed, in said sunk rooms so as to be able to rise/fall freely, each being capable of receiving flight bodies such as dummies of a fish inside thereof;

interlock projections which each fit in said cutout holes of said sunk rooms and engage with said engagement parts when each of said receptacles is lowered against said spring; and a group of projections, being equipped on a bottom plate of said table board, which is installed under said sunk rooms, each releasing said interlock projections from the engagement by each hitting against said interlock projections, in engagement with each of said engagement parts, shifting together with the rotation of said rotary disk, wherein a side wall part is formed by bending downward a rim part of said rotary disk, a roller rotating in contact with said side wall part is equipped, a drive motor for rotating said roller via reduction gears is equipped, and a switch for a power supply to said motor is attached on the surface of said table board.

* * * * *